US008480275B2

(12) United States Patent
Owen et al.

(10) Patent No.: US 8,480,275 B2
(45) Date of Patent: Jul. 9, 2013

(54) MOLDED LAMP SOCKET

(75) Inventors: Robert H. Owen, Columbia City, IN (US); John A. Forish, Huntertown, IN (US)

(73) Assignee: Federal-Mogul World Wide, Inc., Southfield, MI (US)

( * ) Notice: Subject to any disclaimer, the term of this patent is extended or adjusted under 35 U.S.C. 154(b) by 1366 days.

(21) Appl. No.: 11/553,193

(22) Filed: Oct. 26, 2006

(65) Prior Publication Data

US 2007/0091646 A1 Apr. 26, 2007

Related U.S. Application Data

(60) Provisional application No. 60/730,448, filed on Oct. 26, 2005.

(51) Int. Cl.
*F21V 7/04* (2006.01)

(52) U.S. Cl.
USPC ..... 362/549; 362/546; 362/548

(58) Field of Classification Search
USPC ..... 362/459–549
See application file for complete search history.

(56) References Cited

U.S. PATENT DOCUMENTS

| | | | | |
|---|---|---|---|---|
| 3,487,353 | A | 12/1969 | Massa | |
| 3,945,708 | A | 3/1976 | Griffin | |
| 4,631,651 | A * | 12/1986 | Bergin et al. | 362/519 |
| 5,156,560 | A | 10/1992 | Thomas | |
| 5,462,622 | A | 10/1995 | Small et al. | |
| 5,729,898 | A | 3/1998 | Ogawa | |
| 5,821,490 | A | 10/1998 | Blossfeld | |
| 5,823,816 | A | 10/1998 | Uchida et al. | |
| 5,887,342 | A | 3/1999 | Maier et al. | |
| 5,926,952 | A | 7/1999 | Ito | |
| 5,971,733 | A | 10/1999 | Huang | |
| 6,083,054 | A | 7/2000 | Suzuki et al. | |
| 6,109,944 | A | 8/2000 | Takeyama | |
| 6,139,334 | A | 10/2000 | Forish et al. | |
| 6,200,171 | B1 | 3/2001 | Fusselman et al. | |

(Continued)

FOREIGN PATENT DOCUMENTS

| | | | |
|---|---|---|---|
| JP | 5039373 | A | 2/1993 |
| JP | 06188039 | A | 7/1994 |

(Continued)

OTHER PUBLICATIONS

European Search Report EP09818490 mailed on May 15, 2012.

*Primary Examiner* — William Carter
(74) *Attorney, Agent, or Firm* — Robert L. Stearns; Dickinson Wright, PLLC

(57) ABSTRACT

A molded lamp socket. The molded lamp socket includes a lamp base body defining a socket cavity with an opening for receiving a lamp bulb. The molded lamp socket also includes a lead extending from a first contact portion disposed in the socket cavity to a second contact portion spaced from the socket cavity. The molded lamp socket also includes a mounting body defining a plug cavity encircling the second contact portion. The mounting body is overmolded with respect to the lamp base body and less than all of the lead, the second contact portion being exposed. The lamp base body is formed from a first plastic with a first level of resistance to out-gassing and the mounting body is formed from a second plastic with a second level of resistance to out-gassing less than the first level of out-gassing.

12 Claims, 10 Drawing Sheets

U.S. PATENT DOCUMENTS

| | | | | |
|---|---|---|---|---|
| 6,254,252 | B1 | 7/2001 | Coushaine et al. | |
| 6,319,448 | B1 | 11/2001 | Kirchdoerffer et al. | |
| 6,527,989 | B1 | 3/2003 | Onoda | |
| 6,601,296 | B1 | 8/2003 | Dailey et al. | |
| 6,830,471 | B2 | 12/2004 | Okita et al. | |
| 7,052,301 | B2 | 5/2006 | Garcia et al. | |
| 7,066,772 | B2 | 6/2006 | Takahashi | |
| 7,121,900 | B2 | 10/2006 | Thomas et al. | |
| 7,204,711 | B2 | 4/2007 | Garcia et al. | |
| 2002/0094716 | A1 | 7/2002 | Miwa | |
| 2003/0178926 | A1 | 9/2003 | Bryant | |
| 2004/0165411 | A1* | 8/2004 | Heath et al. | 365/110 |

FOREIGN PATENT DOCUMENTS

| | | | |
|---|---|---|---|
| JP | 07022104 | A | 1/1995 |
| JP | 07312272 | | 11/1995 |
| JP | 08008011 | | 1/1996 |
| JP | 08-250076 | | 9/1996 |
| JP | 08236232 | | 9/1996 |
| JP | 2000-3767 | | 1/2000 |
| JP | 2000208199 | | 7/2000 |
| JP | 2004-523079 | | 7/2004 |
| KR | 1020000065132 | | 11/2000 |
| WO | 2007050710 | A2 | 5/2007 |
| WO | 2007050710 | A3 | 11/2007 |

* cited by examiner

MOLDED LAMP SOCKET

CROSS REFERENCE TO RELATED APPLICATIONS

This application claims the benefit of U.S. Provisional Patent Application Ser. No. 60/730,448 for a MOLDED LIGHT SOCKET, filed on Oct. 26, 2005, which is hereby incorporated by reference in its entirety.

BACKGROUND OF THE INVENTION

1. Field of the Invention

The invention relates to a plastic socket for receiving and mounting a light emitting structure, such as a lamp bulb.

2. Description of Related Art

There are at least two types of bulb mounting structures for vehicular lamps such as a tail lamp, turn signal lamp, stop lamp, clearance lamp, or side marker lamp. In a first type of first bulb mounting structure, a lamp bulb is inserted into a lamp body through a bulb insertion hole formed in a rear wall of the lamp body. A socket is disposed behind the rear wall and receives the lamp bulb. In a second type of bulb mounting structure, a rear cover is fitted in an opening formed in the rear wall of the lamp body, and a lamp bulb and socket are mounted on the inner surface of the rear cover.

SUMMARY OF THE INVENTION

A molded lamp socket. The molded lamp socket includes a lamp base body defining a socket cavity with an opening for receiving a lamp bulb. The molded lamp socket also includes a lead extending from a first contact portion disposed in the socket cavity to a second contact portion spaced from the socket cavity. The molded lamp socket also includes a mounting body defining a plug cavity encircling the second contact portion. The mounting body is overmolded with respect to the lamp base body and less than all of the lead, the second contact portion being exposed. The lamp base body is formed from a first plastic with a first level of resistance to out-gassing and the mounting body is formed from a second plastic with a second level of resistance to out-gassing less than the first level of out-gassing.

BRIEF DESCRIPTION OF THE DRAWINGS

Advantages of the present invention will become more readily appreciated when considered in connection with the following detailed description and appended drawings, wherein:

FIG. 3 is a second close-up perspective view of the first structure;

DETAILED DESCRIPTION OF THE PREFERRED EMBODIMENT

Figure 1:
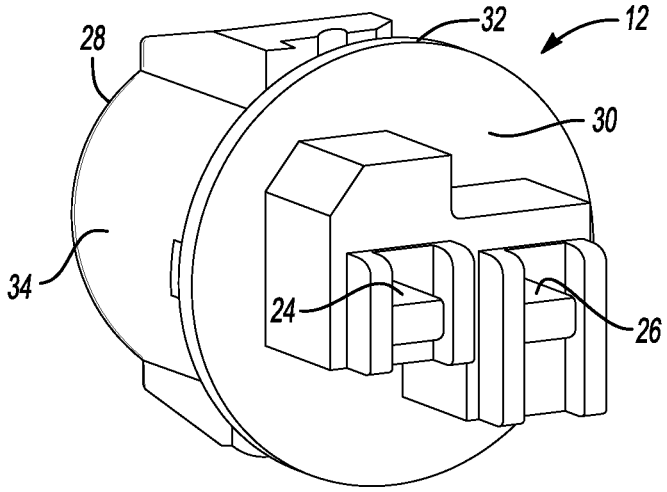
FIG. 1 is a first perspective view of a first structure formed from a first plastic.
Figure 2:
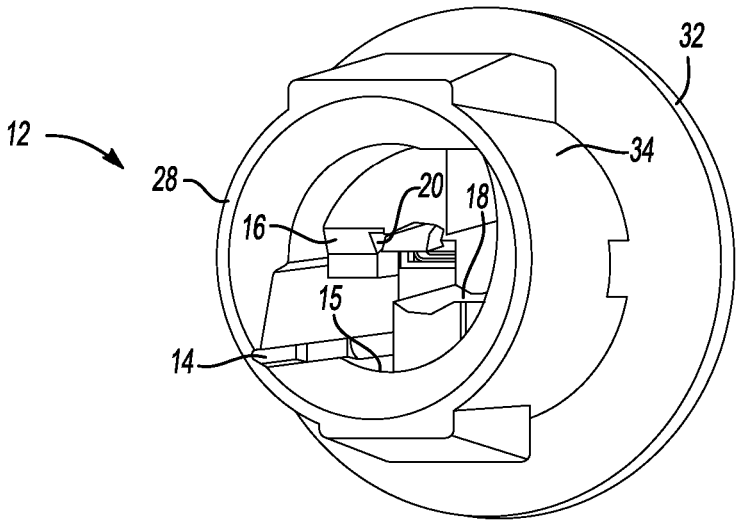
FIG. 2 is a second perspective view of the first structure.
Figure 3:
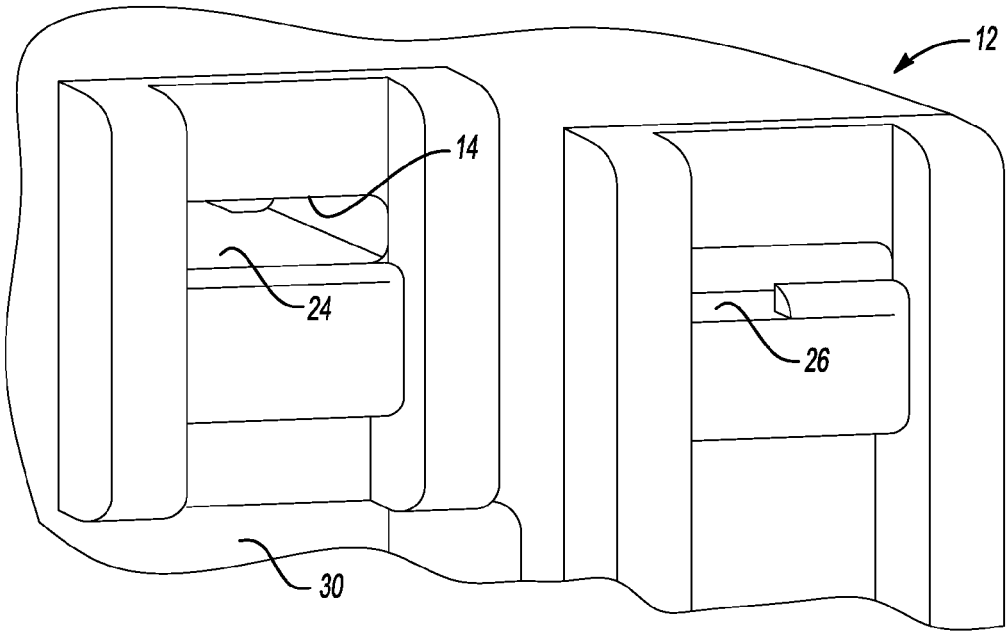
FIG. 3 is a first close-up perspective view of the first structure.
Figure 4:
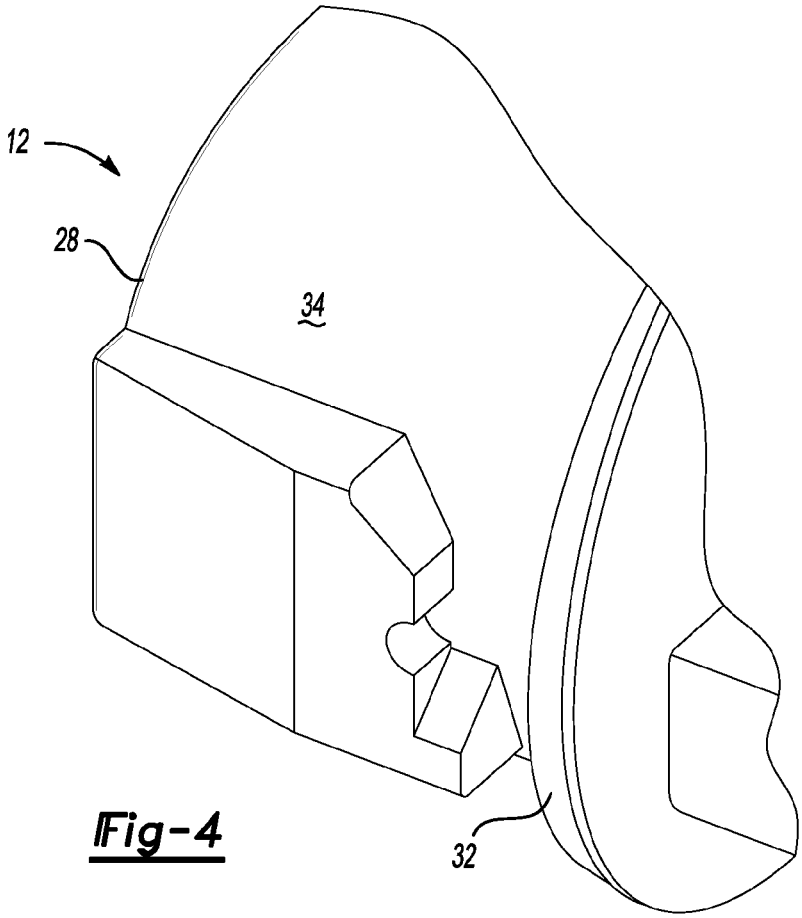
FIG. 4 is a third close-up perspective view of the first structure.
Figure 5:
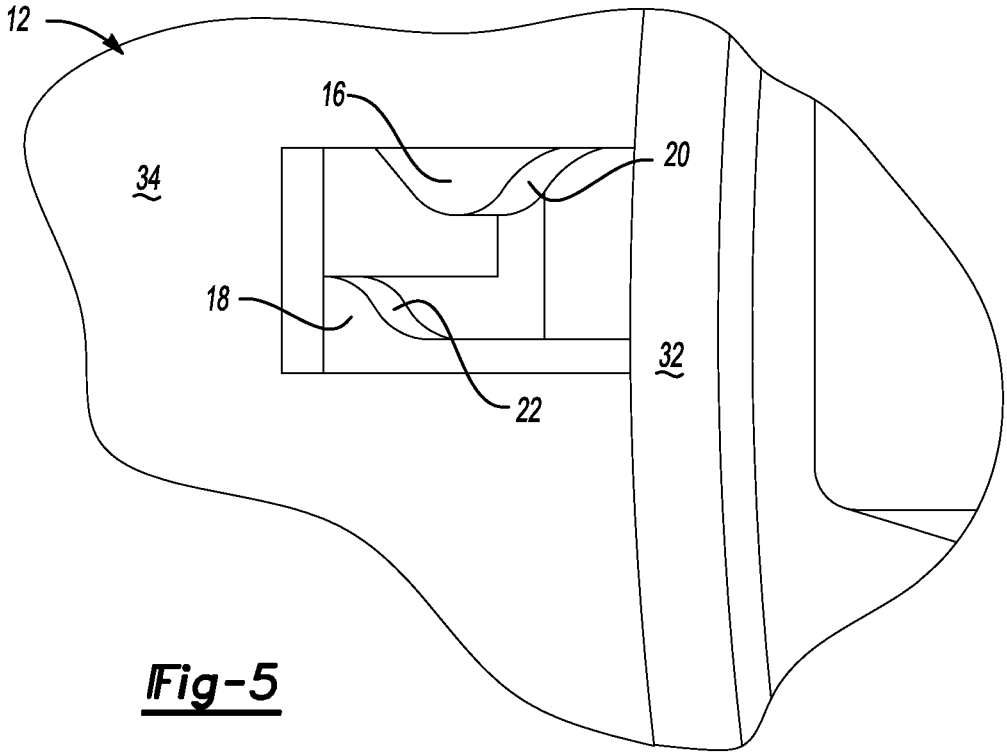
FIG. 5 is a fourth close-up perspective view of the first structure.
Figure 6:
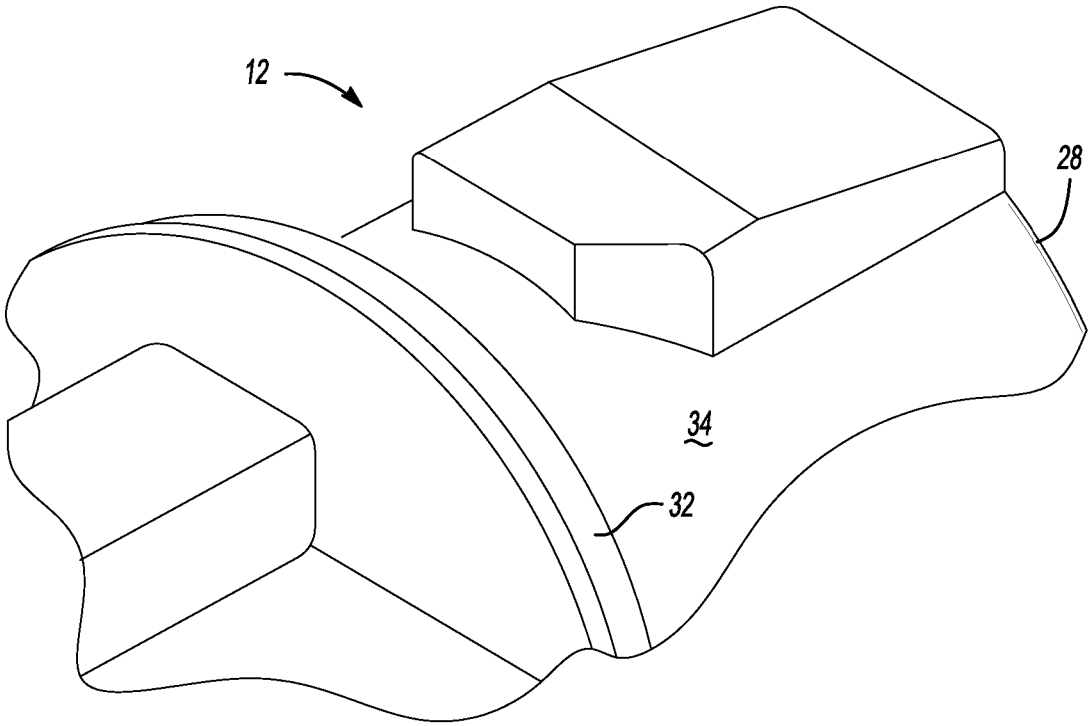
FIG. 6 is a fifth close-up perspective view of the first structure.
Figure 7:
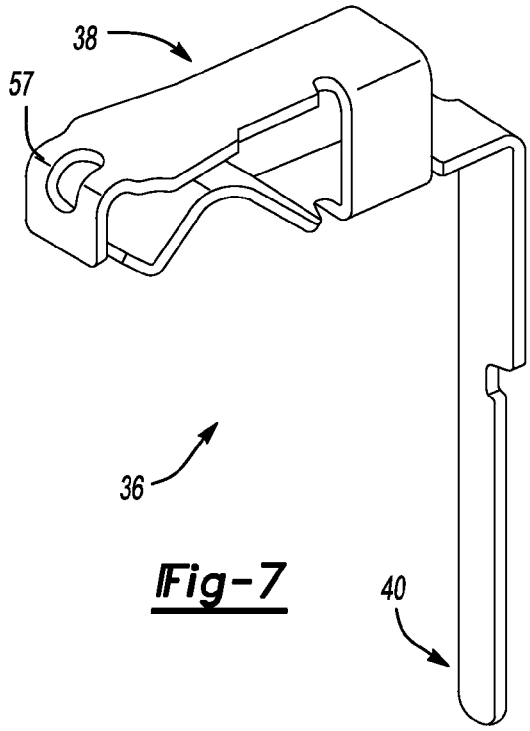
FIG. 7 is a first perspective view of a lead formed from an electrically conductive material.
Figure 8:
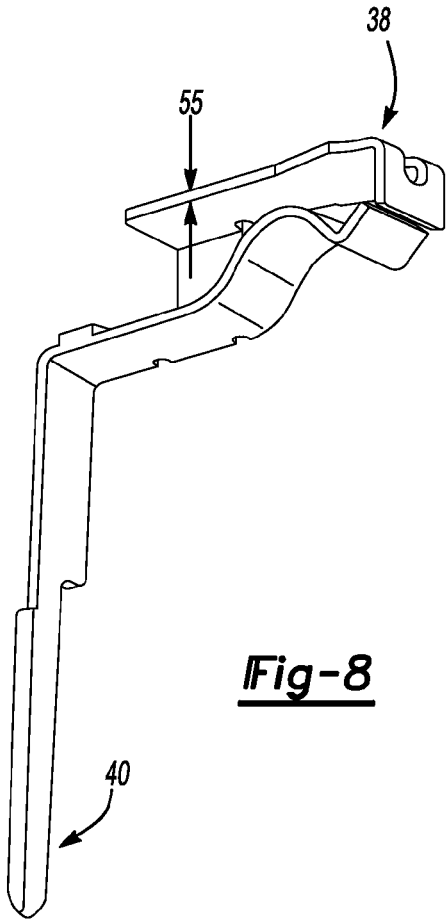
FIG. 8 is a second perspective view of the lead.
Figure 9:
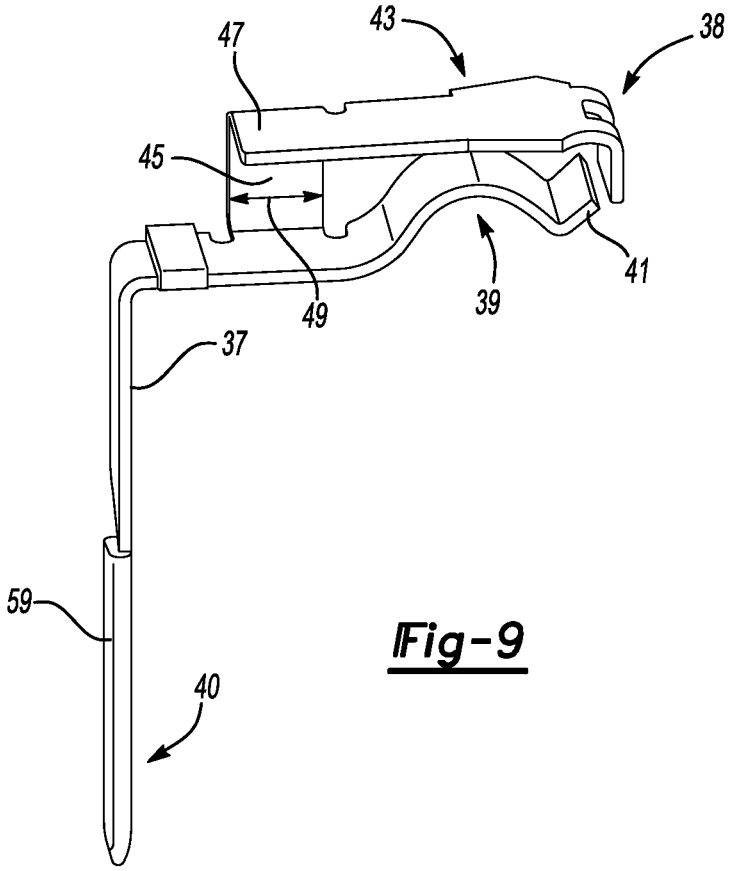
FIG. 9 is a third perspective view of the lead.
Figure 10:
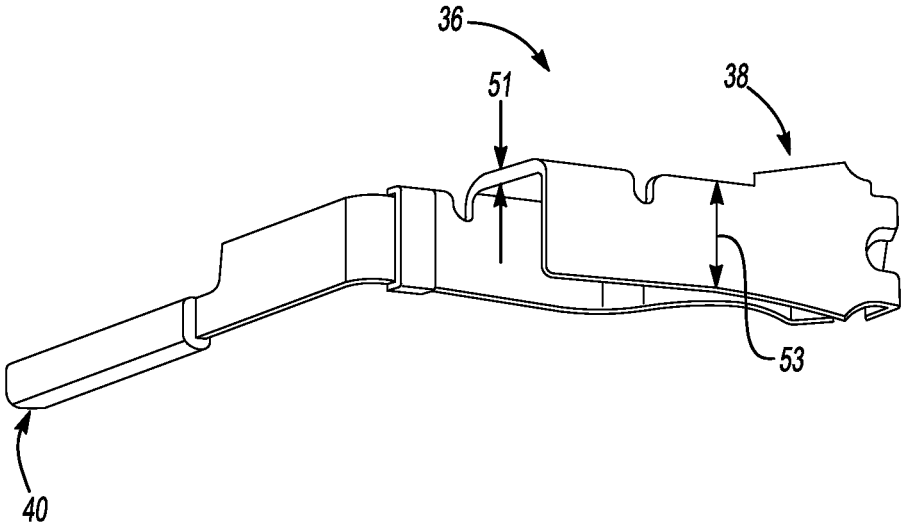
FIG. 10 is a fourth perspective view of the lead.
Figure 11:
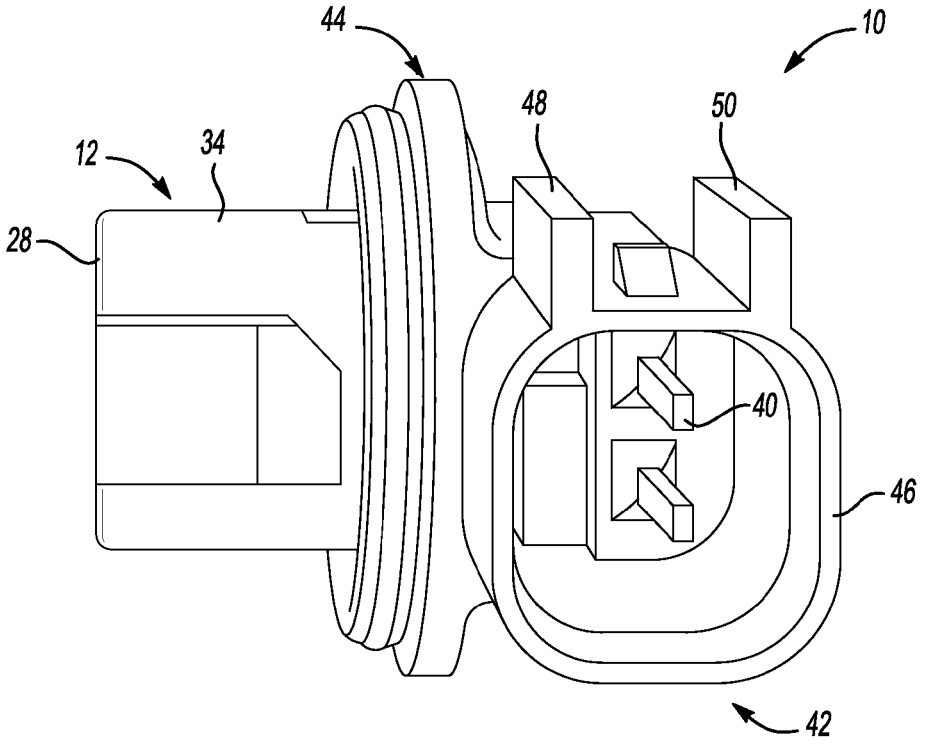
FIG. 11 is a first perspective view of a molded light socket according to the exemplary embodiment of the invention.
Figure 12:
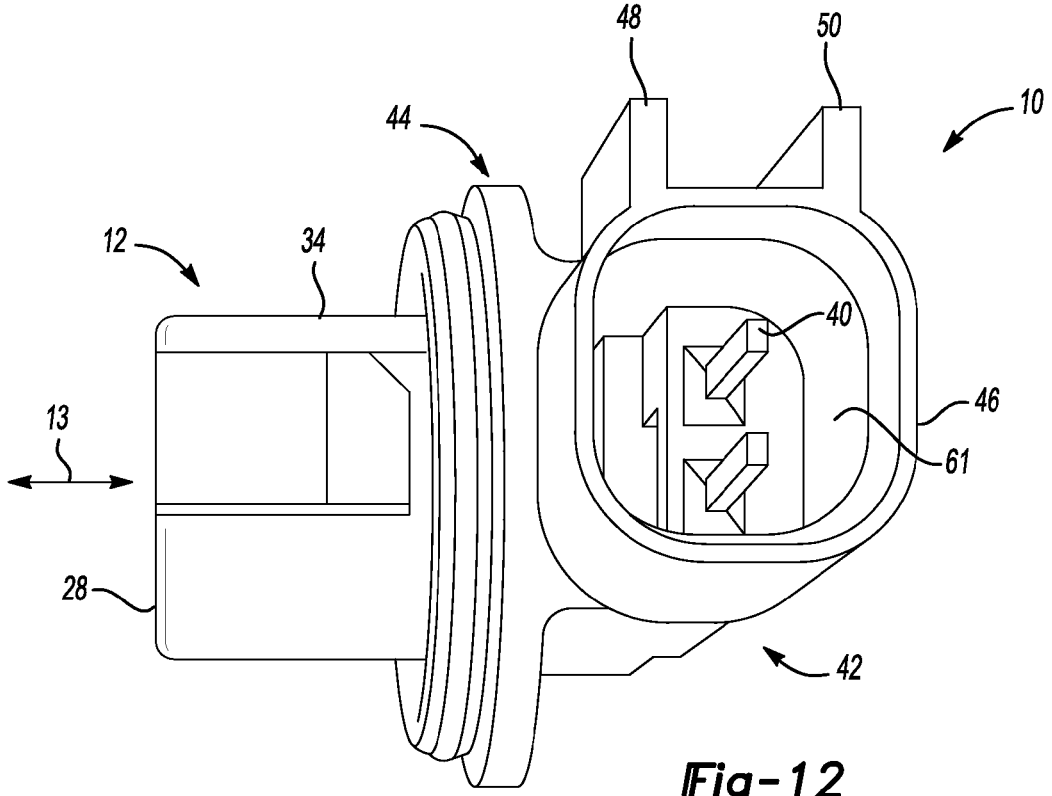
FIG. 12 is a second perspective view of the molded light socket.
Figure 13:
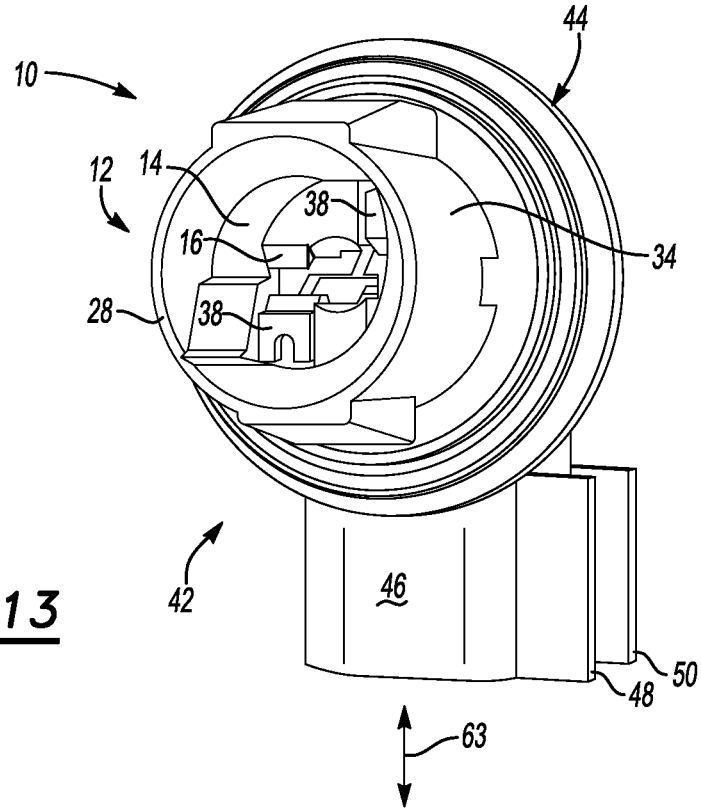
FIG. 13 is a third perspective view of the molded light socket.
Figure 14:
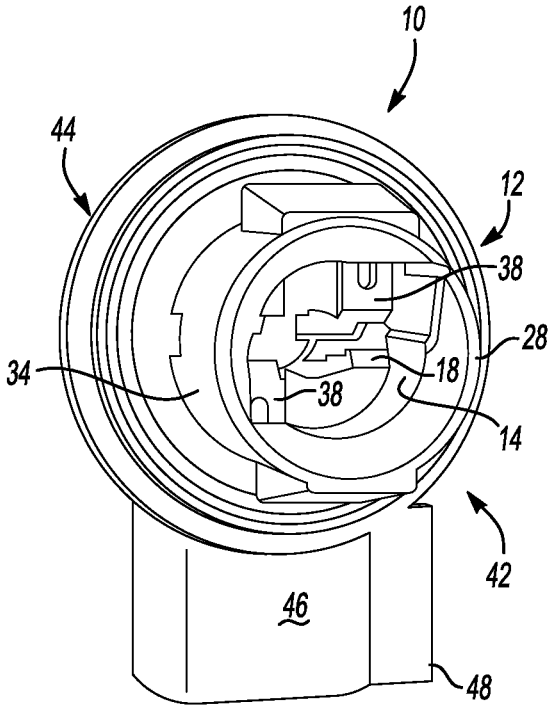
FIG. 14 is a fourth perspective view of the molded light socket.
Figure 15:
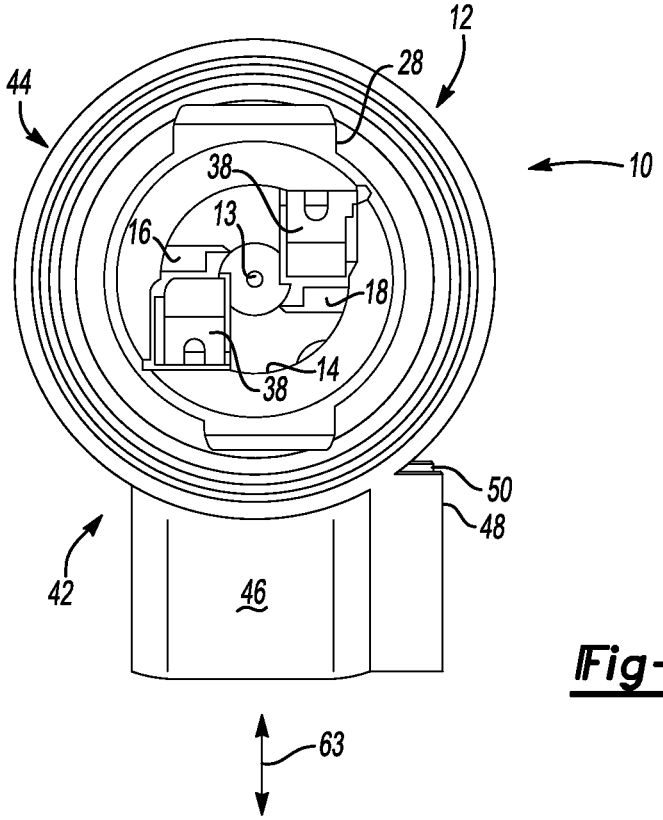
FIG. 15 is a fifth perspective view of the molded light socket.
Figure 16:
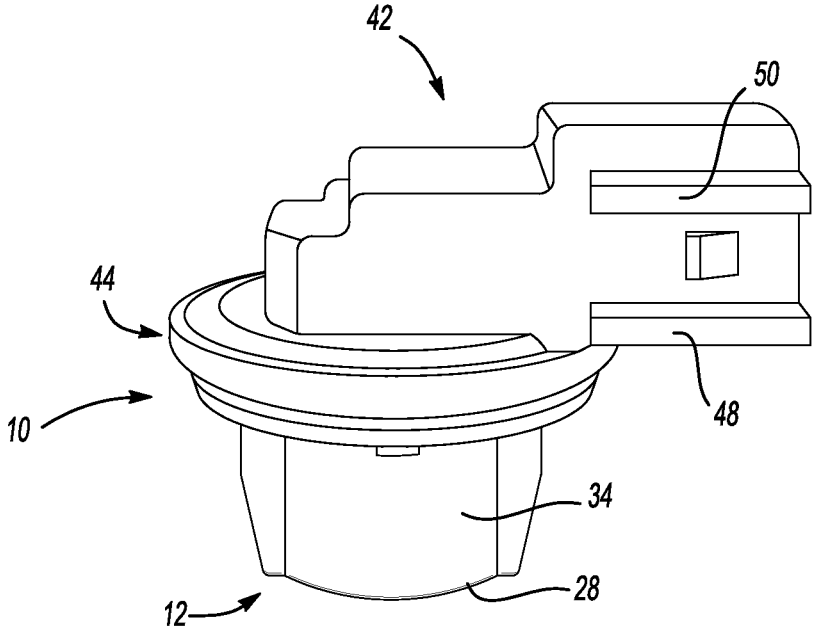
FIG. 16 is a sixth perspective view of the molded light socket.
Figure 17:
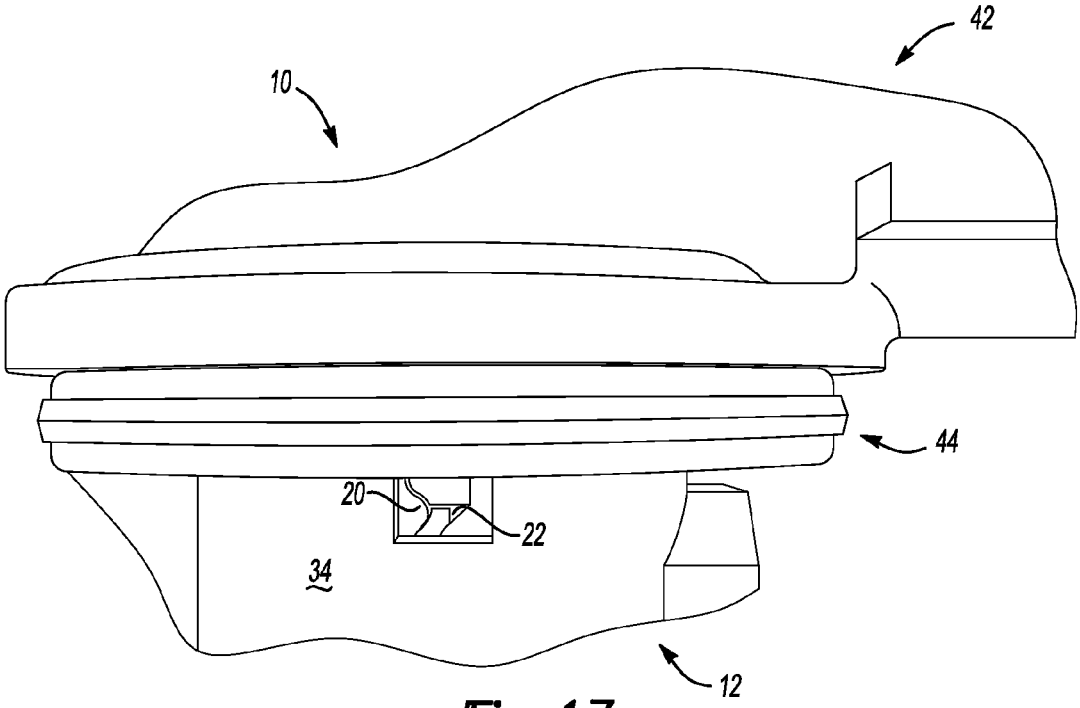
FIG. 17 is a first close-up perspective view of the molded light socket.
Figure 18:
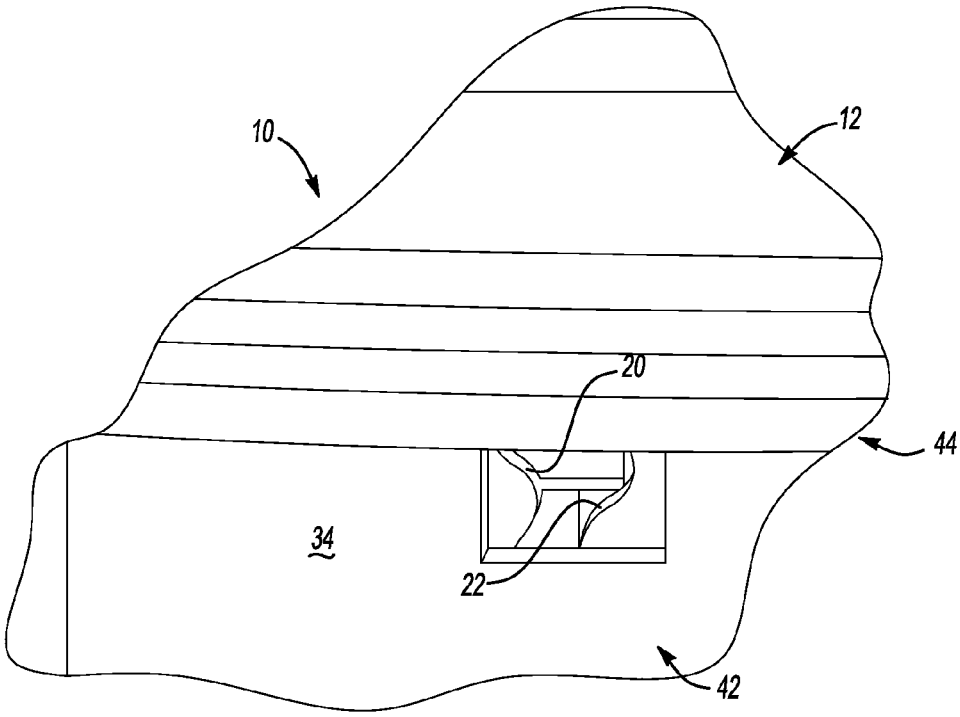
FIG. 18 is a second close-up perspective view of the molded light socket.

A plurality of different embodiments of the invention are shown in the Figures of the application. Similar features are shown in the various embodiments of the invention. Similar features have been numbered with a common reference numeral and have been differentiated by an alphabetic designation. Also, to enhance consistency, features in any particular drawing share the same alphabetic designation even if the feature is shown in less than all embodiments. Similar features are structured similarly, operate similarly, and/or have the same function unless otherwise indicated by the drawings or this specification. Furthermore, particular features of one embodiment can replace corresponding features in another embodiment unless otherwise indicated by the drawings or this specification.

As best shown in FIGS. 1-6 and 11-18, a molded lamp socket 10 includes a lamp base body 12. The lamp base body 12 is formed from a first plastic operable to be adjacent to a lamp bulb. In particular, lamp base body 12 is formed from a first plastic having a first level of resistance to out-gassing. Out-gassing is the phenomena of constituents of plastic being vaporized when the plastic is subjected to heat. Out-gassing can occur in molded lamp socket by the heat generated by the lamp bulb. When this occurs, the constituents can deposit on the lens of the lamp bulb and make the bulb appear fogged over. The first plastic can be nylon 4,6, such as stanyl. The lamp base body 12 can withstand the heat generated by a lamp bulb. The lamp base body 12 includes a socket cavity 14 with an opening 15 for receiving the lamp bulb. The lamp bulb can be a T5 lamp bulb, or any other bulb configuration.

The lamp base body 12 also includes first and second apertures 24, 26. The first and second apertures 24, 26 communicate with the socket cavity 14. The purpose of the first and second apertures 24, 26 will be set forth below.

As best shown in FIGS. 7-18, the molded lamp socket 10 also includes a plurality of leads 36. The lead 36 is formed from electrically conductive material. The lead 36 includes a receptacle end 38 defining a first contact portion 41 to engage a conductive portion of the lamp bulb. The lead 36 also includes a terminal end 40 projecting out of the molded lamp socket 10 and defining a second contact portion 59.

Referring now additionally to FIGS. 1-6, the terminal end 40 of a first lead 36 can be inserted in the socket cavity 14 and through the first aperture 24 to engage the first lead 36 with the lamp base body 12. The terminal end 40 of a second lead 36 can be inserted in the socket cavity 14 and through the second aperture 26 to engage the second lead 36 with the lamp base body 12. The socket cavity 14 can form first and second receiving portions to receiving the receptacle ends 38 of the first and second leads 36 so that the leads 36 are relatively fixed to the lamp base body 12.

Each of the leads 36 includes a lead body 37. The receptacle end 38 is at one end of the lead body 37 and the terminal end 40 is at the other end of the lead body 40. In the exemplary embodiment of the invention, the lead body 37 and the contact arm 39 and the shield arm 43 are integrally formed with respect to one another. The receptacle end 38 includes a contact arm 39 extending cantilevered from the lead body 37 along a torturous path to the first contact portion 41. The receptacle end 38 also includes a shield arm 43 extending cantilevered from the lead body 37, between the contact arm 39 and the opening 15. The contact arm 39 defines a first level of resistance to bending about the lead body 37 away from the opening 15 and the shield arm 43 defines a second level of resistance to bending about the lead body 37 away from the opening 15. The second level of resistance to bending is greater than the first level of resistance to bending to reduce the likelihood of the contact arm 39 bending when the lamp bulb is received in the socket cavity 14.

The shield arm 43 includes a first portion 45 extending from the lead body 37 substantially parallel to the opening 15. The shield arm 43 also includes a second portion 47 extending from the first portion 45 substantially perpendicular to the opening 15. The first portion defines a width 49 perpendicular to the opening 15 and a thickness 51 parallel to the opening 15. The thickness 51 is less than the width 49. The second portion 47 defines a width 53 parallel to the opening 15 and a thickness 55 parallel to the opening 15. The thickness 55 is less than the width 53. The structure of the shield arm 43 enhances the second level of resistance to bending about the lead body 37.

When a lamp bulb is inserted, the bulb will engage or encounter the shield arm 43 prior to reaching the contact arm 39. The shield arm 43 prevents the bulb from damaging the contact arm 39 if insertion is attempted while the bulb is not properly aligned with the socket cavity 14. During insertion when the bulb is properly aligned, the bulb will ride over a rounded end 57 of the shield arm 43 an snap into place. The entire receptacle end 38 may shift slightly during insertion. The bulb is retained between the receptacle ends 38 of the two leads and first and second projections 16, 18 that extend into the socket cavity 14. The first and second projections 16, 18 are integrally formed with the lamp base body 12 and define locking tabs 20, 22. The tabs 20, 22 cooperate with the shield arms 43 of both leads 36 to engage the lamp bulb. The lamp bulb is releasibly locked with respect to the lamp base body 12. The locking tabs 20, 22 can be shaped to conform to a depression-like portion of the lamp bulb. In alternative embodiments of the invention, the lamp base body 12 could define depressions communicating with the socket cavity 14 to receive projection-like portions of the lamp bulb.

Thus, the bulb is captured between the lead 36 and the plastic lamp base body 12. This arrangement allows the lead 36 to be relatively thicker. In some lamp sockets, the bulb is urged between two metal portions that must both deflect to accommodate the bulb during insertion. Each of the two metal portions must be relatively thinner so that the bulb will not be subjected to undesirable stresses that may result from deforming two metal pieces. Furthermore, the relatively thicker lead results in a relatively thick shield arm 43.

The lamp base body 12 extends along a longitudinal axis 13 between a first end 28 and a second end 30. An annular ridge 32 extends radially outwardly from a cylindrical body portion 34 of the lamp base body 12. The purpose of the annular ridge 32 will be set forth below. In alternative embodiments of the invention, the body portion could be shaped non-cylindrical, such as square, rectangular, or some other shape.

The molded lamp socket 10 also includes a mounting body 42. The mounting body 42 is formed from a second plastic different from the first plastic. In the exemplary embodiment of the invention, the second plastic is less operable to withstand the energy emitter from the lamp bulb than the first plastic. In particular, mounting body 42 is formed from a second plastic having a second level of resistance to out-gassing, less than the first level of resistance to out-gassing possessed by the lamp base body 12. The second plastic can be nylon 6,6.

The mounting body 42 is molded over the assembled lead 36 and lamp base body 12. In other words, the mounting body 42 is formed with the lamp base body 12 and the leads 36 disposed in situ. The mounting body 42 is molded over the annular ridge 32 and the second end 30. After molding, the lamp base body 12 and the mounting body 42 are fixed with respect to one another. Also, after molding, portions of the leads 36 extending between the first and second apertures 24, 26 and the terminal ends 40 are enclosed by the mounting body 42.

The mounting body 42 can include a seal mounting portion 44 to support a seal, such as a rubber gasket or o-ring. The mounting body 42 can also include a wall 46 to facilitate guided engagement between the terminal ends 40 and a female connection. The wall 46 defines a plug cavity 61 encircling the second contact portions 59 of the leads 36. The plug cavity is centered on an axis 63. The mounting body 42 can also include projections 48, 50 to facilitate guided movement between the molded lamp socket 10 and a mounting structure, such as on a vehicle.

In an exemplary method for forming the molded lamp socket 10, the lamp base body 12 is formed from a first plastic in a mold. First and second leads 36 are inserted in the socket cavity 14 and through the first and second apertures 24, 26 respectively. The receptacle ends 38 of the leads 36 can cooperate with the socket cavity 14 to substantially fix the position of the leads 36 prior to formation of the mounting body 42. After the leads 36 have been assembled to the lamp base body 12, the second structure is molded over the annular ridge 32 and the second end 30 of the first structure, enclosing the first and second apertures 24, 26 and a portion of the leads 36 between the receptacle end 38 and the terminal end 40.

Figure 19:
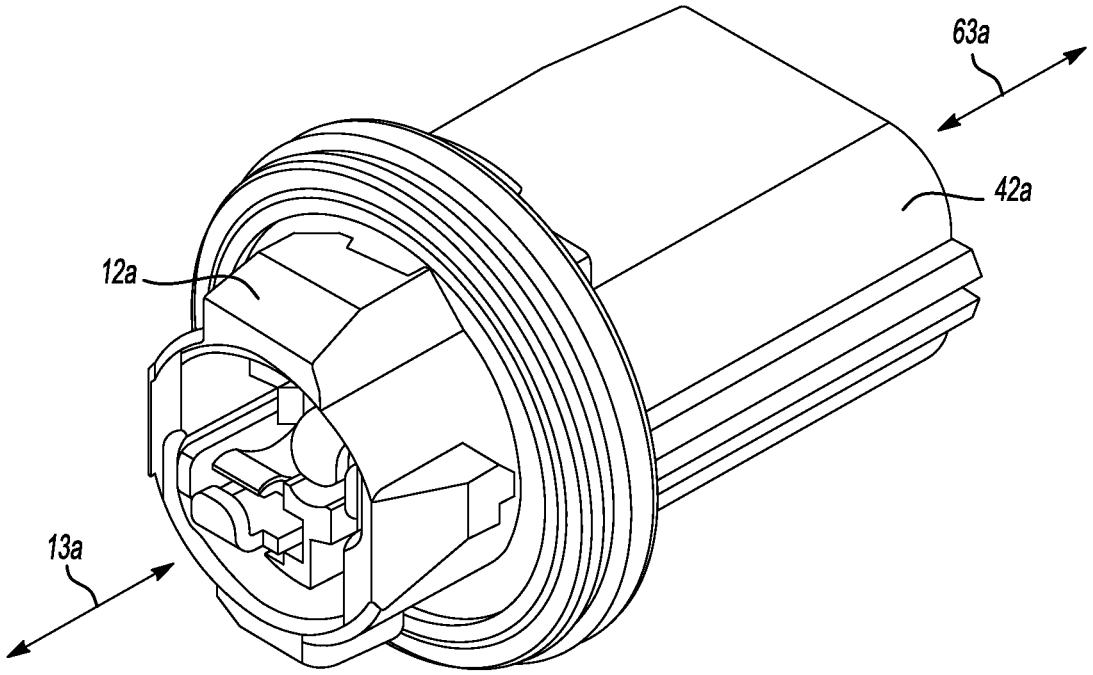
FIG. 19 is a perspective view of a second embodiment of the invention.

In the first exemplary embodiment of the invention shown in FIGS. 1-18, the axis 13 of the lamp body 12 and the axis 63 of the mounting body 42 are transverse to one another. More specifically, the axis 13, 63 are perpendicular to one another. The axis 13, 63 could be less or more than 90 degrees transverse to one another in alternative embodiments of the invention. In a second exemplary embodiment of the invention shown in FIG. 19, the axis 13*a* of the lamp body 12*a* and the axis 63*a* of the mounting body 42*a* are aligned with one another. In alternative embodiments of the invention, the axis 13*a*, 63*a* could be parallel to one another.

Many modifications and variations of the present invention are possible in light of the above teachings. It is, therefore, to be understood that within the scope of the appended claims, the invention may be practiced otherwise than as specifically described.

What is claimed is:

1. A molded lamp socket comprising:

a lamp base body defining a socket cavity with an opening for receiving a lamp bulb;

a lead extending from a first contact portion disposed in said socket cavity to a second contact portion spaced from said socket cavity;

a mounting body defining a plug cavity encircling said second contact portion and overmolded in bonded, fixed relation with respect to said lamp base body and less than all of said lead, wherein said lamp base body is formed from a first plastic with a first level of resistance to out-gassing and said mounting body is formed from a second plastic with a second level of resistance to out-gassing less than said first level of out-gassing;

said lead including a lead body;

a contact arm extending cantilevered from said lead body along a torturous path to said first contact portion; and a shield arm extending cantilevered from said lead body and between said contact arm and said opening wherein said contact arm defines a first level of resistance to bending about said lead body away from said opening and said shield arm defines a second level of resistance to bending about said lead body away from said opening greater than said first level of resistance to bending to reduce the likelihood of said contact arm bending when the lamp bulb is received in said socket cavity.

2. The molded lamp socket of claim 1 wherein said shield arm further comprises:

a first portion extending from said lead body substantially parallel to said opening; and a second portion extending from said first portion substantially perpendicular to said opening.

3. The molded lamp socket of claim 1 wherein:

said first portion defines a width perpendicular to said opening and a thickness parallel to said opening and said thickness being less than said width; and said second portion defines a width parallel to said opening and a thickness parallel to said opening and said thickness being less than said width.

4. The molded lamp socket of claim 1 wherein said lead body and said contact arm and said shield arm are integrally formed with respect to one another.

5. The molded lamp socket of claim 1 wherein said lamp base body further comprises an integrally-formed locking tab opposing said first contact portion across said socket cavity to cooperate with said shield arm in releasibly retaining the lamp bulb received in said socket cavity.

6. The molded lamp socket of claim 1 wherein said socket cavity is further defined as being substantially centered on a first axis and said plug cavity is further defined as being substantially centered on a second axis and said first and second axis are further defined as being one of transverse and aligned with respect to one another.

7. The molded lamp socket of claim 1 wherein said lamp base body further comprises an annular ridge, said mounting body being overmolded over said annular ridge.

8. A molded lamp socket comprising:

a lamp base body having a socket cavity with an opening for receiving a lamp bulb;

a lead extending from a first contact portion disposed in said socket cavity to a second contact portion spaced from said socket cavity;

a mounting body having a plug cavity encircling said second contact portion, said mounting body being overmolded in bonded, fixed relation with said lamp base body and at least a portion of said lead;

said lead including a lead body;

a contact arm extending cantilevered from said lead body along a torturous path to said first contact portion; and a shield arm extending cantilevered from said lead body and between said contact arm and said opening wherein said contact arm defines a first level of resistance to bending about said lead body away from said opening and said shield arm defines a second level of resistance to bending about said lead body away from said opening greater than said first level of resistance to bending to reduce the likelihood of said contact arm bending when the lamp bulb is received in said socket cavity.

9. The molded lamp socket of claim 8 wherein said lamp base body further comprises an annular ridge, said mounting body being overmolded over said annular ridge.

10. A method of constructing a lamp socket, comprising:

forming a lamp base body having an aperture and a socket cavity with an opening for receiving a lamp bulb;

inserting a lead in the aperture, the lead including a lead body, a contact arm extending cantilevered from the lead body along a torturous path to the first contact portion, and a shield arm extending cantilevered from the lead body and between the contact arm and the opening wherein the contact arm defines a first level of resistance to bending about the lead body away from the opening and the shield arm defines a second level of resistance to bending about the lead body away from the opening greater than the first level of resistance to bending to reduce the likelihood of the contact arm bending when the lamp bulb is received in the socket cavity; and overmolding a mounting body in fixed, bonded relation to at least a portion of the lamp base body and providing the mounting body with a plug cavity extending about a portion of the lead.

11. The method of claim 10 further including overmolding the mounting body in fixed, bonded relation to a portion of the lead.

12. The method of claim 10 further including providing the lamp base body with an annular ridge and overmolding a portion of the mounting body in fixed relation to the annular ridge.

* * * * *